US007153111B2

(12) United States Patent
Bush et al.

(10) Patent No.: US 7,153,111 B2
(45) Date of Patent: Dec. 26, 2006

(54) SCREW MACHINE

(75) Inventors: James W. Bush, Skaneateles, NY (US); Clark V. Cooper, Glastonbury, CT (US); Ronald T. Drost, Colchester, CT (US); Hong Du, Weathersfield, CT (US); Harry E. Eaton, Woodstock, CT (US); Hussein E. Khalifa, Manlius, NY (US); Keshava B. Kumar, S. Windsor, CT (US); Reng Rong Lin, Manlius, NY (US); Philip H. McCluskey, Dunlap, IL (US); Raymond DeBlois, deceased, late of Tolland, CT (US); by Paula R. DeBlois, legal representative, Tolland, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/307,766

(22) Filed: Dec. 2, 2002

(65) Prior Publication Data

US 2004/0033152 A1 Feb. 19, 2004

Related U.S. Application Data

(62) Division of application No. 09/607,764, filed on Jun. 30, 2000, now Pat. No. 6,506,037.

(51) Int. Cl.
*F01C 21/00* (2006.01)

(52) U.S. Cl. ..... 418/178; 418/201.1

(58) Field of Classification Search ..... 418/178, 418/201.1

See application file for complete search history.

(56) References Cited

U.S. PATENT DOCUMENTS

| | | | | |
|---|---|---|---|---|
| 2,754,050 | A | | 7/1956 | Wellington |
| 2,882,189 | A | | 4/1959 | Russel et al. |
| 3,833,321 | A | * | 9/1974 | Telang et al. ..... 418/178 |
| 4,466,785 | A | | 8/1984 | Biswas |
| 4,490,102 | A | * | 12/1984 | Carre et al. ..... 418/201.1 |
| 4,549,862 | A | * | 10/1985 | Stich et al. ..... 418/178 |
| 4,695,233 | A | | 9/1987 | Miyoshi et al. |
| 4,764,098 | A | | 8/1988 | Iwase et al. |
| 5,011,389 | A | | 4/1991 | Timuska |
| 5,116,912 | A | | 5/1992 | Lindert et al. |
| 5,288,556 | A | | 2/1994 | Lemelson |
| 5,314,321 | A | | 5/1994 | Yamamoto et al. |
| 5,364,250 | A | | 11/1994 | Aoki et al. |
| 5,554,020 | A | | 9/1996 | Rao et al. |
| 5,638,600 | A | | 6/1997 | Rao et al. |
| 5,672,054 | A | * | 9/1997 | Cooper et al. ..... 418/178 |
| 5,947,710 | A | | 9/1999 | Cooper et al. |
| 5,993,183 | A | | 11/1999 | Laskaris et al. |

(Continued)

FOREIGN PATENT DOCUMENTS

DE 3 609 996 A1 10/1987

(Continued)

*Primary Examiner*—Theresa Trieu
(74) *Attorney, Agent, or Firm*—Wall Marjama & Bilinski LLP

(57) ABSTRACT

A screw machine (10) has a rotor housing (12) defining overlapping bores (12-1, 12-2). Female rotor (14) is located in bore (12-1) and male rotor (16) is located in bore (12-2). A wear resistant coating is deposited on the tips (14-1, 16-1) of the rotors. A conformable coating is deposited on the valleys (14-2, 16-2) of the rotors. A conformable coating is depsoited on the surface of the bores coacting with the rotors.

9 Claims, 6 Drawing Sheets

U.S. PATENT DOCUMENTS 6,290,480 B1 9/2001 Lifson

FOREIGN PATENT DOCUMENTS

| | | | | |
|---|---|---|---|---|
| EP | 0 378 009 | A3 | | 7/1990 |
| GB | 535554 | | | 4/1941 |
| GB | 2121112 | A | | 12/1983 |
| JP | 56-75992 | A | | 6/1981 |
| JP | 58048792 | A | * | 3/1983 |
| JP | 60-56190 | A | | 4/1985 |
| JP | 60-56191 | A | | 4/1985 |
| JP | 61-190184 | | | 8/1986 |
| JP | 61-192880 | A | | 8/1986 |
| JP | 179190 | A | | 8/1991 |
| JP | 05001685 | A | * | 1/1993 |
| JP | 05149278 | A | * | 6/1993 |
| JP | 05288176 | A | * | 11/1993 |
| JP | 08-177772 | A | | 12/1996 |

* cited by examiner

SCREW MACHINE

REFERENCE TO RELATED APPLICATION

This application is a division of U.S. patent application Ser. No. 09/607,764, filed 30 Jun. 2000, now U.S. Pat. No. 6,506,037 for Screw Machine.

BACKGROUND OF THE INVENTION

In a conventional screw machine, a male rotor and a female rotor, disposed in respective parallel overlapping bores defined within a rotor housing, coact to trap and compress volumes of gas. While two rotors are the most common design, three, or more, rotors may coact in pairs. The male and female rotors differ in their lobe profiles and in the number of lobes and flutes. For example, the female rotor may have six lobes separated by six flutes, the while conjugate male rotor may have five lobes separated by five flutes. Accordingly, each possible combination of lobe and flute coaction between the rotors occurs on a cyclic basis. The coaction between the conjugate pairs of rotors is a combination of sliding and rolling contact which can produce different rates of wear. In addition to coacting in pairs, the rotors coact as well with the housing. Because all combinations of rotor contact takes place between conjugate pairs, the sealing/leakage between the various combinations may be different due to manufacturing tolerances and wear patterns. This can be the case even though manufacturing tolerances are held very tight with the attendant manufacturing costs and adequate lubrication or other liquid injection is provided for sealing.

The profile design of conjugate pairs of screw rotors must be provided with a clearance in most sections. The need to provide a clearance is the result of a number of factors including: thermal growth of the rotors as a result of gas being heated in the compression process; deflection of the rotors due to pressure loading resulting from the compression process; tolerances in the support bearing structure and machining tolerances on the rotors which may sometimes tend to locate the rotors too close to one another which can lead to interference; and machining tolerances on the rotor profiles themselves which can also lead to interference. Superimposed upon these factors is the existence of pressure and thermal gradients as the pressure and temperature increase in going from suction to discharge.

The pressure gradient is normally in one direction during operation such that fluid pressure tends to force the rotors towards the suction side. The rotors are conventionally mounted in bearings at each end so as to provide both radial and axial restraint. The end clearance of the rotors at the discharge side is critical to sealing and the fluid pressure tends to force open the clearance.

There are certain sections of the rotor, such as the contact band, where zero clearance is maintained between the rotors. The segment of the rotor defining the contact band is the region where the required torque is transmitted between the rotors. The load between the rotors is different for a male rotor drive and for a female rotor drive. In a male drive the loading between the rotors may be equivalent to about 10% of the total compressor torque, whereas in the case of female rotor drive the loading between the rotors may be equivalent to about 90% of the total compressor torque. These segments are conventionally positioned near the pitch circles of the rotors which is the location of equal rotational speed on the rotors resulting in rolling contact and thereby in reduced or no sliding contact and thus less wear.

A substantial amount of end-running clearance must be maintained at the discharge end of screw compressors in order to prevent failure from rotor seizure. Seizure may be caused by the thermal expansion of the rotor or by the intermittent contacts between the rotors and the end casing due to pressure pulsations in the compression process.

SUMMARY OF THE INVENTION

It is an object of this invention to reduce leakage in a screw machine.

It is another object of this invention to relax machining tolerances without increasing leakage.

It is a further object of this invention to reduce oil sealing requirements in screw machines.

It is an additional object of this invention to minimize the power loss due to friction and to prevent wear. These objects, and others as will become apparent hereinafter, are accomplished by the present invention.

In accordance with the present invention, a coating is applied to one or more portions of the screw rotors and/or the inner bore surfaces of the housing.

In one aspect of the present invention, a low friction, wear resistant material may be deposited on the rotor tip where the rotors can have nominal contact with the housing as well as normal contact with each other. The rotors coact with each other, in pairs, as well as with the housing. While tight machining tolerances reduce the leakage due to these coactions between the rotors themselves and also with the housing, other things can be done in conjunction with the tight tolerances or in lieu of tight tolerances. Examples of suitable low friction, wear resistant coatings include multilayer diamond-like-carbon (DLC) coating, titanium nitride and other single material, single layer nitride coatings, as well as carbide and ceramic coatings having both high wear resistance and a low coefficient of friction.

In another aspect of the present invention, conformable coatings may be located on the inner bore surfaces of the housing and/or in the rotor valleys. Examples of suitable conformable coatings include iron phosphate coating, magnesium phosphate coating, nickel polymer amalgams and other materials that yield elastically when a force is applied. Placement of conformable coatings on the inner bore surfaces of the housing and/or in the rotor valleys can reduce leakage and oil sealing requirements while relaxing manufacturing tolerances.

A surface coated or otherwise equivalently treated with such a low friction, wear resistant material is more forgiving to sliding contact than is an untreated surface. There also exists a synergistic effect associated with such a treatment in that the coated surface has a greater tolerance to sliding contact. In accordance with a further aspect of the present invention, this allows the contact band to be moved further away from the pitch circle, thus further reducing the contact force and reducing the overall wear potential over even the treated rotor with a relocated contact band. Locating the contact band near the pitch circles of the rotors is the conventional practice, as noted, and represents the desire to have nearly pure rolling contact.

The location of the contact band is a design feature and can be removed from the pitch circle or otherwise located where you wish. By moving the contact band away from the pitch circle the loading between the rotors can be reduced and this is particularly important for a female rotor drive. As contact starts to move away from the pitch circle there is more sliding contact rather than pure rolling contact. The blow hole area, which refers to the leakage area defined be the meshing rotor tips and the edge of the cusp between adjacent bores of a screw machine, can only be reduced to zero if the respective pitch circles correspond to the root circle of the male rotor and the tip circle of the female rotor. This necessarily requires the contact band to be located away from the pitch circle in response to trade-offs between the transmission angle, contact pressure, machineability of the root radius of the male rotor, and the amount of sliding that will take place.

The penalty for maintaining this large end-running clearance is to increase the leakage from the high pressure zone into the low pressure zone. In accordance with a further aspect of the present invention, by applying a wear resistant coating having a low coefficient of friction at the end face of the rotors or at the surface of the end casing or by inserting a coated piece between the rotor ends and the end casing, the end-running clearance can be reduced at least by 50%. The compressor performance is improved due to the reduced leakage at the discharge end.

BRIEF DESCRIPTION OF THE DRAWINGS

For a fuller understanding of the present invention, reference should now be made to the following detailed description of various embodiments thereof taken in conjunction with the accompanying drawings wherein.

DESCRIPTION OF THE PREFERRED EMBODIMENTS

Figure 1:
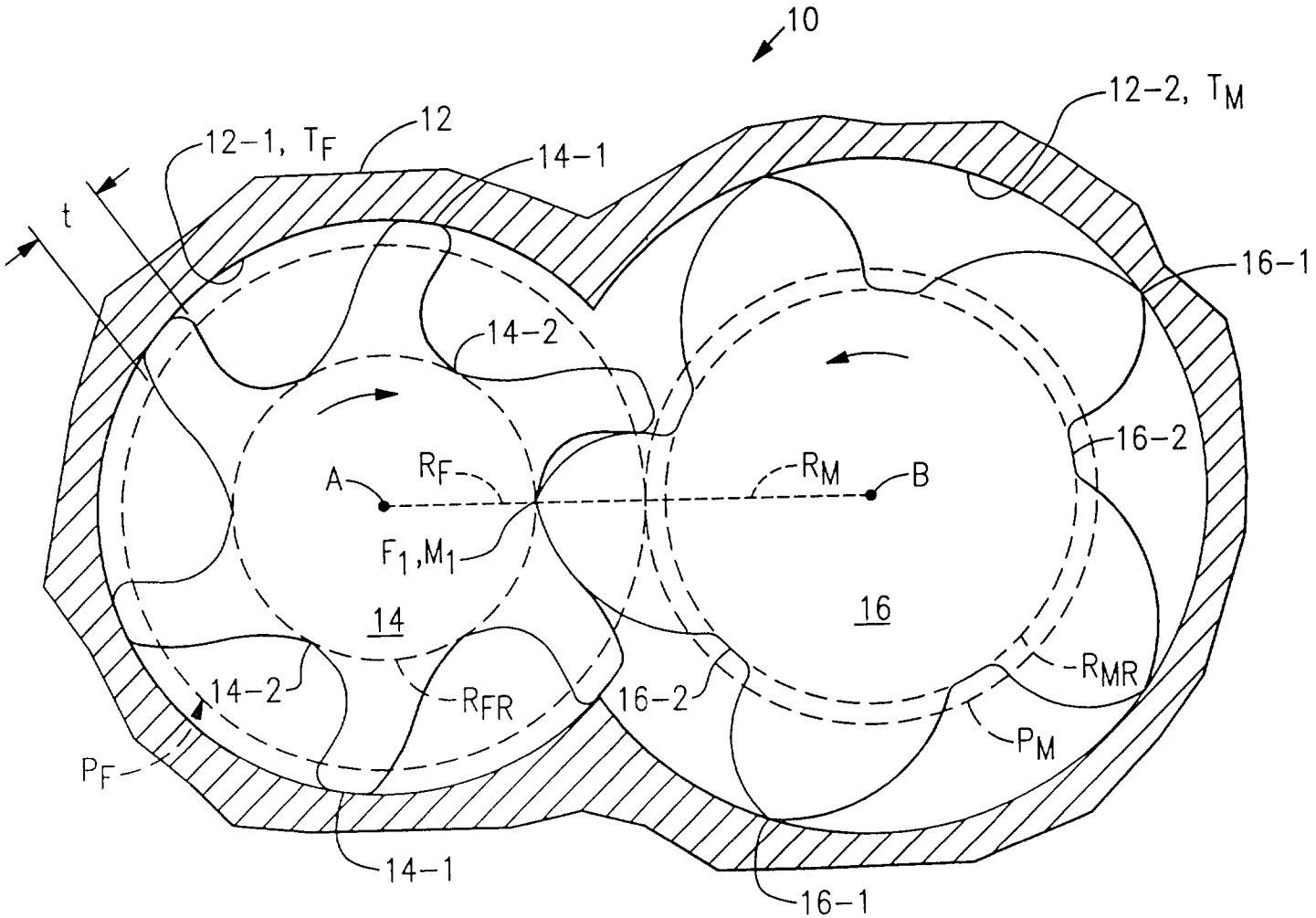
FIG. 1 is a transverse section through a screw machine.

In FIG. 1, there is depicted a screw machine 10, such as a screw compressor, having a rotor housing or casing 12 with overlapping bores 12-1 and 12-2 located therein. Female rotor 14 having a pitch circle, $P_F$, is located in bore 12-1. Male rotor 16 having a pitch circle, $P_M$, is located in bore 12-2. The parallel axes indicated by points A and B are perpendicular to the plane of FIG. 1 and separated by a distance equal to the sum of the radius, $R_F$, of the pitch circle, $P_F$, of female rotor 14 and the pitch radius, $R_M$, of the pitch circle, $P_M$, of male rotor 16. The axis indicated by point A is the axis of rotation of female rotor 14 and generally of the center of bore 12-1 whose diameter generally corresponds to the diameter of the tip circle, $T_F$, of female rotor 14. Similarly, the axis indicated by point B is the axis of rotation of male rotor 16 and generally of the center of bore 12-2 whose diameter generally corresponds to the diameter of the tip circle, $T_M$, of male rotor 16. Typically, the rotor and the bore centerlines are offset by a very small amount to compensate for clearance and deflection. Neglecting operating clearances, the extension of the bore 12-1 through the overlapping portion with bore 12-2 will intersect line A-B at the tangent point with the root circle, $R_{MR}$, of male rotor 16. Similarly, the extension of the bore 12-2 through the overlapping portion with bore 12-1 will intersect line A-B at the tangent point with the root circle, $R_{FR}$, of female rotor 14 and this common point is labeled $F_1$ relative to female rotor 14 and $M_1$ relative to male rotor 16.

In the illustrated embodiments, female rotor 14 has six lands or tips, 14-1, separated by six grooves or flutes, 14-2, while male rotor 16 has five lands or tips, 16-1, separated by five grooves or flutes 16-2. Accordingly, the rotational speed of rotor 16 will be 6/5 or 120% of that of rotor 14. Either the female rotor 14 or the male rotor 16 may be connected to a prime mover (not illustrated) and serve as the driving rotor. Other combinations of the number of female and male lands and grooves may also be used.

Figure 2:
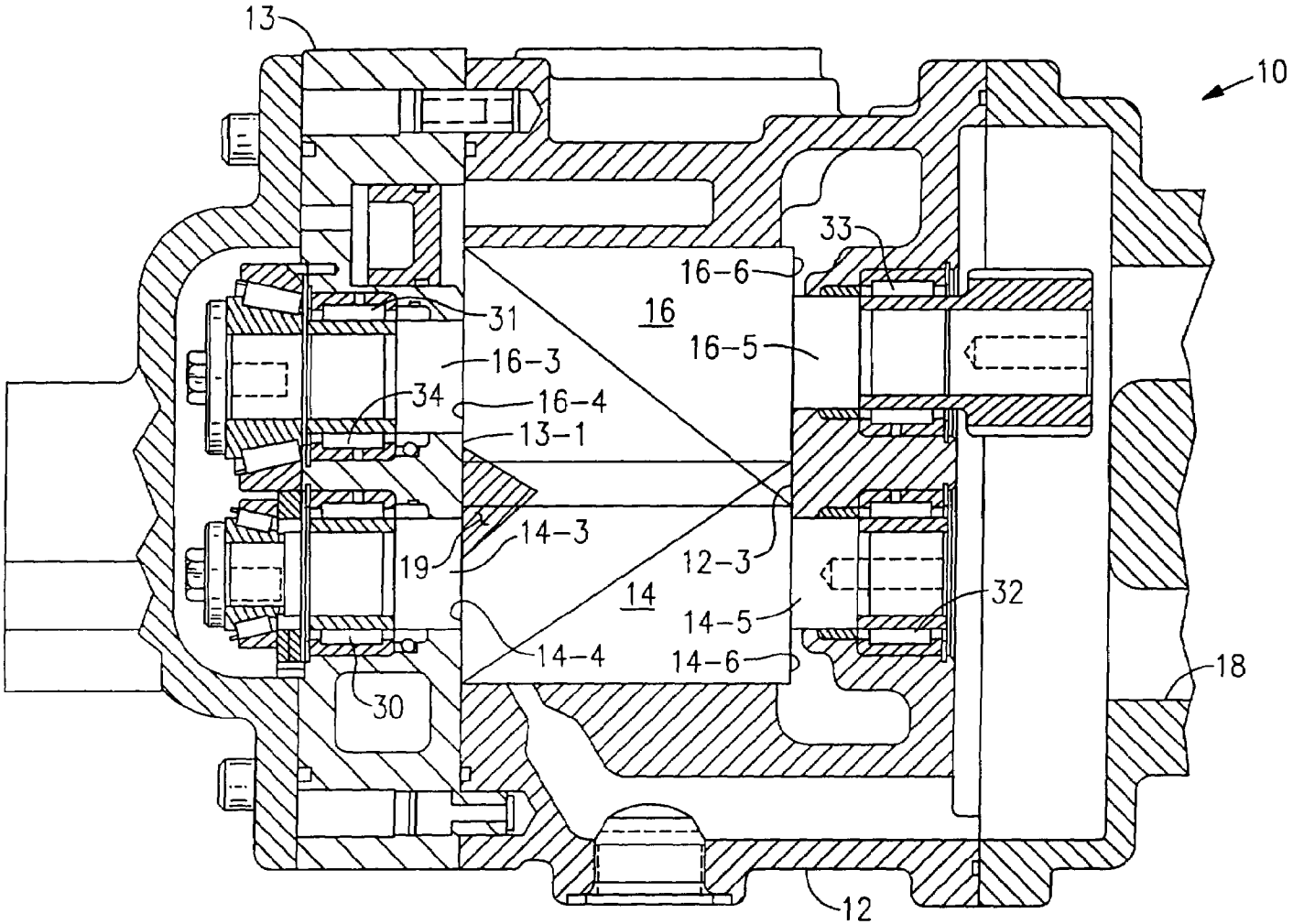
FIG. 2 is a partially sectioned view of the screw machine of FIG. 1.
Figure 3:
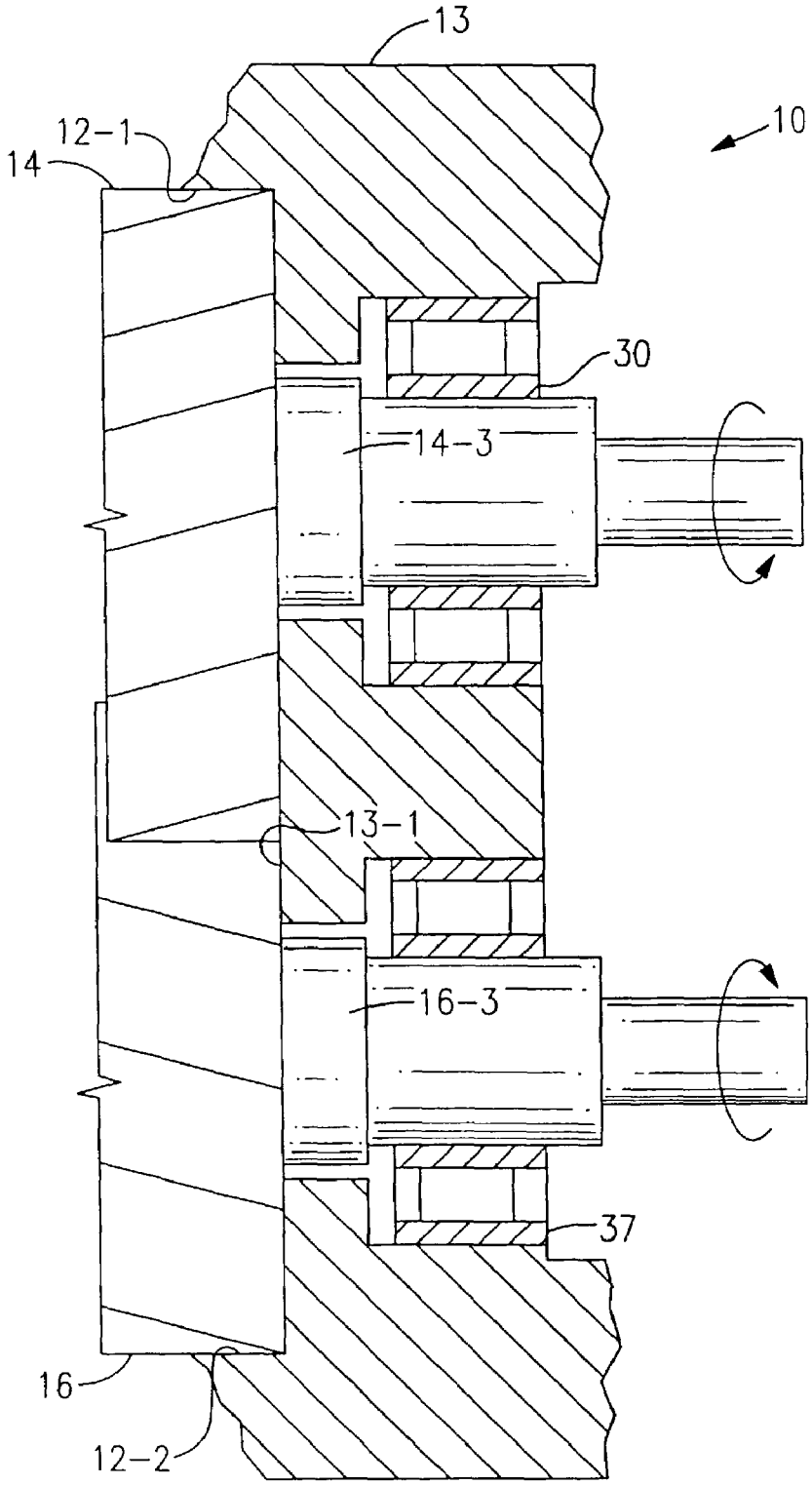
FIG. 3 is an enlarged view of a portion of the discharge end of the screw machine of FIG. 1.

Referring now to FIGS. 2 and 3, rotor 14 has a shaft portion 14-3 with a shoulder 14-4 formed between shaft portion 14-3 and rotor 14. Shaft portion 14-3 of rotor 14 is supported in outlet or discharge casing 13 by one, or more, bearing(s) 30. Similarly, rotor 16 has a shaft portion 16-3 with a shoulder 16-4 formed between shaft portion and the housing will be excessive if contact occurs between the rotors and housing. Even where the rotors are lubricated, there can be leakage across the oil seal and the oil must be removed from the refrigerant to minimize its circulation through the refrigeration system with its deterioration of the heat transfer efficiency as well as to maintain the necessary oil for lubrication in the compressor.

In accordance with one aspect of the present invention, a low friction, wear resistant coating is deposited on the tips or lands 14-1 and 16-1 of the rotors 14 and 16, respectively. One suitable low friction, wear resistant coating is a low friction diamond-like-carbon (DLC) coating of the type used locally on the tip surface of the vane in a rotary compressor as disclosed in commonly assigned U.S. Pat. No. 5,672,054. Such a the DLC coating serves to overcome lubrication difficulties associated with the use of new oil and refrigerant combinations. The DLC coating is both lubricous and also wear resistant in that, as discussed in detail in U.S. Pat. No. 5,672,054, the entire disclosure of which is hereby incorporated by reference, it is made up of alternating layers of a hard material, such as tungsten carbide, and amorphous carbon.

Examples of other suitable low friction, wear resistant coatings include titanium nitride and other single material, single layer nitride coatings, as well as carbide and ceramic coatings having both high wear resistance and a low coefficient of friction. The presence of a low friction, wear resistant coating on the tips or in the valleys of lands of the respective rotors provides several advantages. First, oil free or reduced oil operation relative to the rotors is possible without excessive wear or friction. Second, machining tolerances can be relaxed because some contact with the rotor bores can be tolerated. Third, the need for oil sealing between the rotors and the rotor bores can be reduced or eliminated because of the possibility of running with less clearance between the rotor tips or lands 14-1 and 16-1 and rotor bores 12-1 and 12-2, respectively.

Because the contact band on female rotor 14 is located near the tip, a single DLC coating can be used to cover both areas of interest on the female rotor due to their narrow spacing, or overlap, depending upon the rotor profiles. The single DLC coating 40 on the female rotor is preferred for ease of manufacture as illustrated on FIG. 4. The portion 40-1 of coating 40 corresponds to the contact band and the portion 40-2 corresponds to the portion of tip or land 14-2 that comes closest to bore 12-1. The corresponding DLC coatings on male rotor 16 are more widely separated with the coating 60 deposited on the rotor tips and the coating 61 deposited near the root portion corresponding to the contact band.

Figure 5:
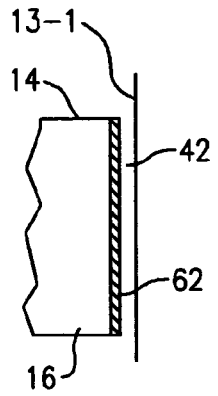
FIG. 5 is a partially sectioned view showing a DLC coating on the rotor ends.
Figure 6:
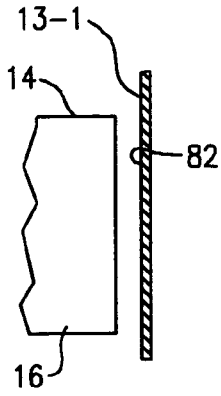
FIG. 6 is a partially sectioned view showing a DLC coating on the on the discharge casing.
Figure 7:
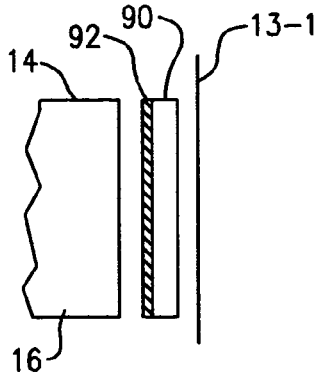
FIG. 7 is a partially sectioned view showing a DLC coated disc.

Like the rotor tips, the rotor ends are run with a clearance that constitutes a leak path. In accordance with a further aspect of the present invention, a DLC coating may be applied at the discharge end faces of the rotors, at the facing surfaces of the discharge casing 13 or on a coated insert disposed between the rotors and the discharge casing 13, whereby the running clearance, and thereby the leakage path, is reduced. Referring now to FIG. 5, a DLC coating is applied to the discharge end of the rotors 14 and 16. Specifically, DLC coating 42 is applied to the discharge end of female rotor 14 and DLC coating 62 is applied to the discharge end of male rotor 16. Because the DLC coatings 42 and 62 can accommodate some contact with outlet casing surface 13-1, a reduced end running clearance can be employed with reduced leakage. Referring now to FIG. 6, the DLC coating 82 is applied to the casing surface 13-1 rather than to the ends of the rotors 14 and 16, as in the FIG. 5 embodiment. In the FIG. 7 embodiment, a separate member 90 is located between the ends of rotors 14 and 16 and casing surface 13-1. Because the member 90 conforms to the cross section of bores 12-1 and 12-2, it is not capable of rotation and the relative movement will be between member 90 and the discharge ends of rotors 14 and 16. Accordingly, only the surface of member 90 facing rotors 14 and 16 needs to be provided with a DLC coating 92. In the embodiments of FIGS. 5–7 a DLC coating is located between the ends of rotors 14 and 16 and surface 13-1 such that its lubricity will protect the rotors and casing from wear during an occasional contact thereby permitting the closing of the end running clearance and narrowing the leakage path.

Figure 8:
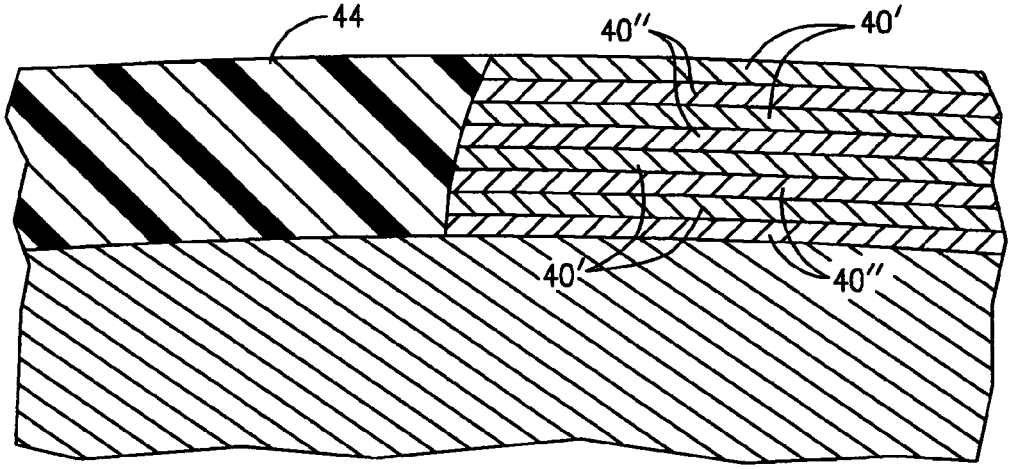
FIG. 8 is an enlarged view of a DLC coating.

Referring now to FIG. 8, a greatly exaggerated cross section typical of coatings 40, 42, 60, 61, 82 and 92 is illustrated although it is labeled 40. DLC coating 40 is made up of hard bilayers 40' and lubricious bilayers 40". The range of bilayer thickness is 1 to 20 nm, with the preferred range being between 5 and 10 nm.

Figure 4:
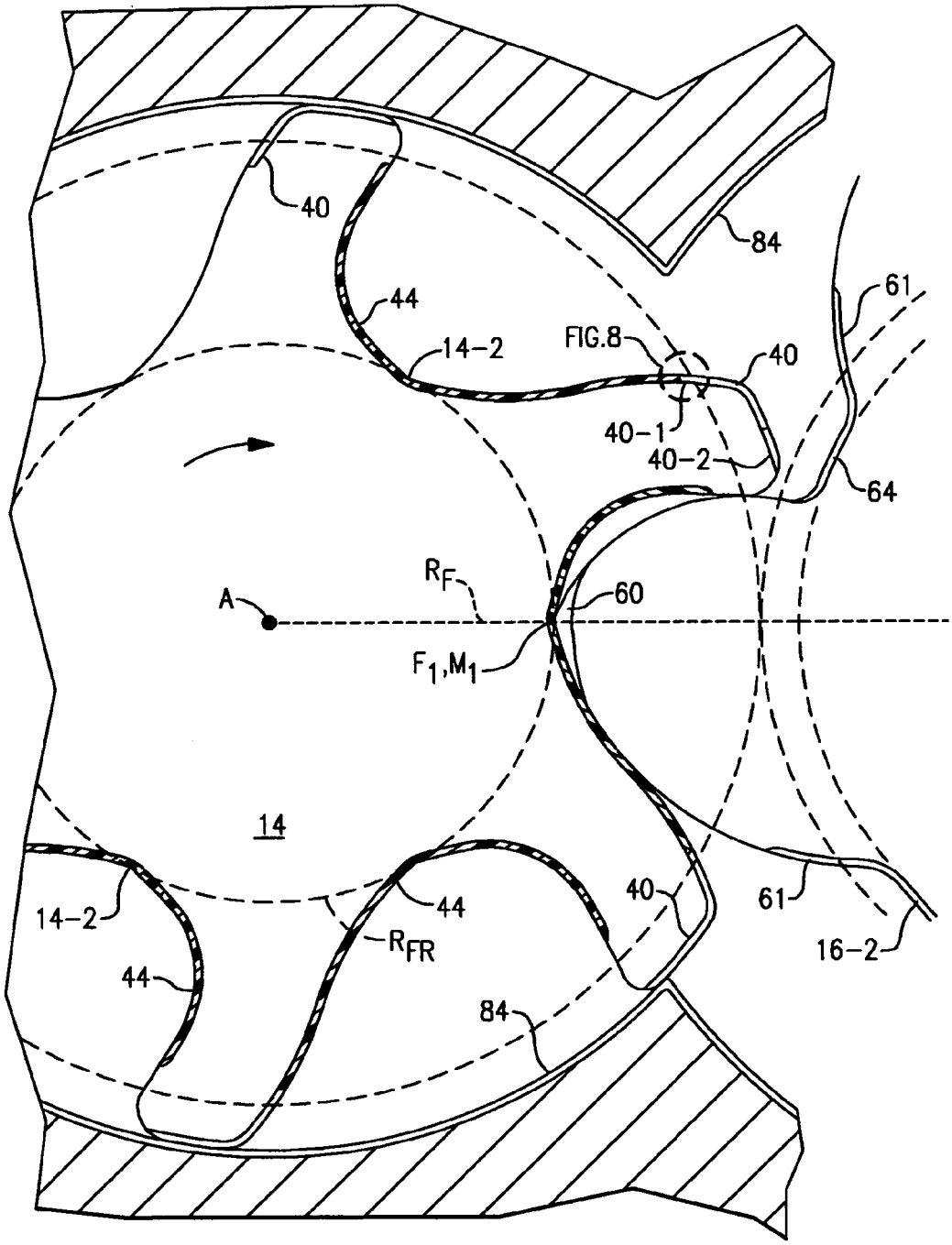
FIG. 4 is an enlarged portion of FIG. 1 with the various coatings of the present invention illustrated.
Figure 9:
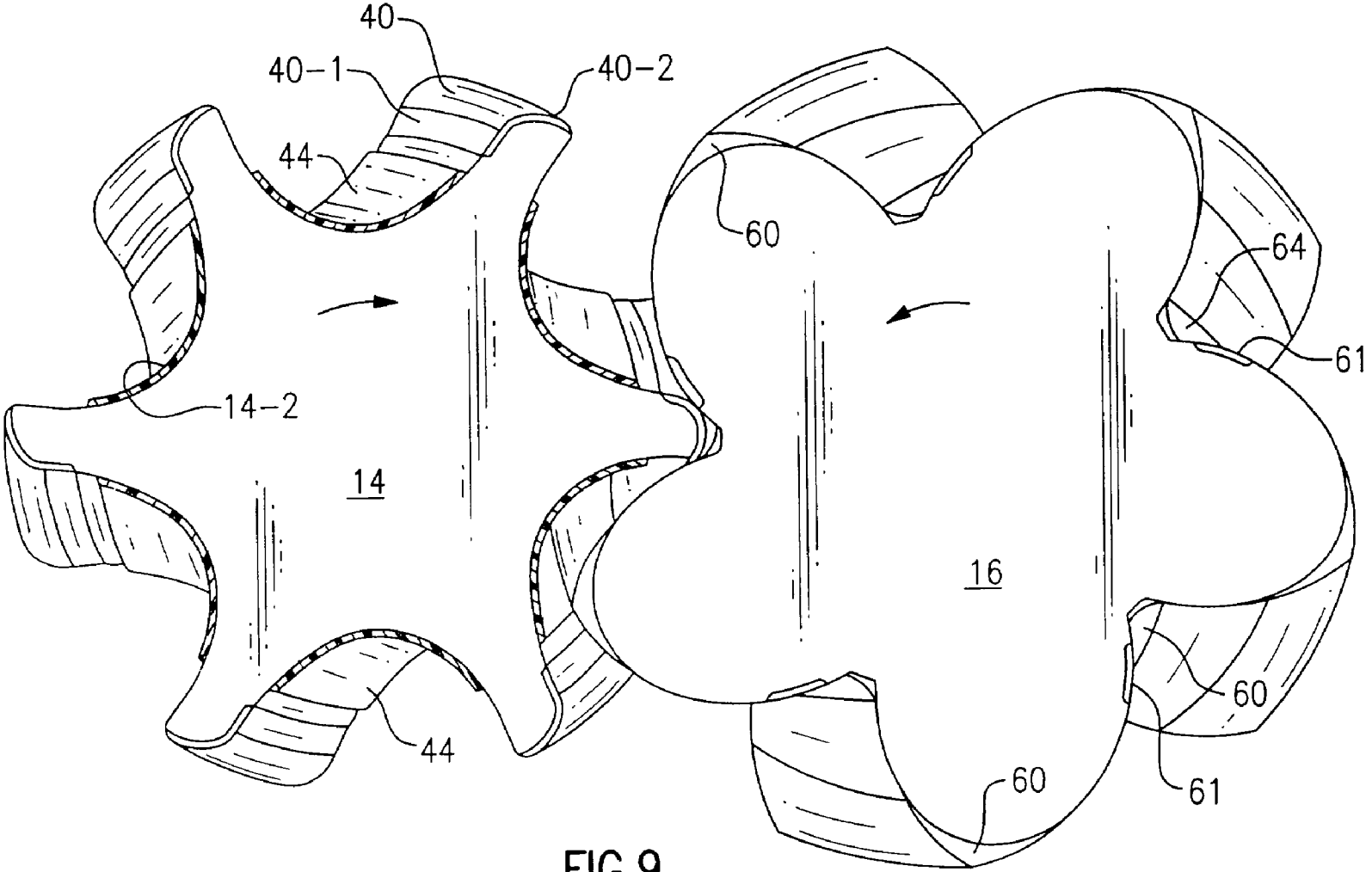
FIG. 9 is a perspective view of an axial section of the rotor pair of FIG. 1.

In accordance with a further aspect of the present invention, a conformable coating, which may be abradable or extrudable into shape, may be applied to the rotors 14 and 16 and/or to the bores 12-1 and 12-2. While the entire rotors and bores may be coated, a localized coating in the rotor flutes or valleys 14-2 and 16-2, respectively, as illustrated in FIG. 9, provides essentially all of the benefits relative to the coaction between the rotors. Although the contact band is a no clearance area and requires precise machining, the tolerances can be relaxed relative to the coaction between the remainder of the rotor lobe profiles. Additionally, the conformable coating of the bores 12-1 and 12-2 accommodates the flexure of the rotors 14 and 16 during actual operation to maintain the sealing function. Referring to FIGS. 4 and 9, the female rotor valleys may be provided with conformable coating 44 and the male rotor valley may be provided with conformable coating 64. Additionally, bores 12-1 and 12-2 may be provided with conformable coating 84.

Various plastically conformable coatings may be used including, for example, iron phosphate, magnesium phosphate, nickel polymer amalgams, nickel zinc alloys, aluminum silicon alloys with polyester, and aluminum silicon alloys with polymethylmethacrylate (PMMA). Also, convention coatings methods, including for example thermal spraying, physical vapor deposition (PVD), chemical vapor deposition (CVD), or any suitable aqueous deposition, may be used to treat the surfaces of the screw machine of the present invention.

Although the present invention has been specifically illustrated and described in terms of a twin rotor screw machine, it is applicable to screw machines employing three, or more rotors. It is therefore intended that the present invention is to be limited only by the scope of the appended claims.

What is claimed is:

1. A screw machine comprising a rotor housing having a pair of parallel, overlapping bores; a conjugate pair of intermeshing rotors located in said bores, each of said rotors having helical lobes and intervening flutes; an outlet casing disposed at a discharge end of said rotor housing, each of said rotors having a discharge end face facing a surface of said outlet casing; characterized by a low friction wear resistant coating disposed between said discharge end faces of said rotors and said outlet casing surface facing said discharge end faces of said rotors.

2. The screw machine of claim 1 wherein said low friction wear resistant coating comprises a low friction wear resistant coating on said discharge end faces of said rotors.

3. The screw machine of claim 2 wherein said low friction wear resistant coating comprises a diamond-like-carbon coating made up of a series of alternating hard and lubricious layers.

4. The screw machine of claim 1 wherein said low friction wear resistant coating comprises a wear resistant coating on said outlet casing surface facing said discharge end faces of said rotors.

5. The screw machine of claim 4 wherein said low friction wear resistant coating comprises a diamond-like-carbon coating made up of a series of alternating hard and lubricious layers.

6. A screw machine comprising a rotor housing having a pair of parallel, overlapping bores; a conjugate pair of intermeshing rotors located in said bores, each of said rotors having helical lobes and intervening flutes; an outlet casing disposed at a discharge end of said rotor housing, each of said rotors having a discharge end facing said outlet casing; a member located intermediate said discharge ends of said rotors and said outlet casing, said member having a surface facing said discharge ends of said rotors, characterized by a wear resistant coating disposed on said surface facing said discharge ends of said rotors.

7. The screw machine of claim 6 wherein said wear resistant coating comprises a diamond-like-carbon coating made up of a series of alternating hard and lubricious layers.

8. A screw machine comprising a rotor housing having a pair of parallel, overlapping bores; a conjugate pair of intermeshing rotors located in said bores, each of said rotors having helical lobes and intervening flutes; an outlet casing disposed at a discharge end of said rotor housing, each of said rotors having a discharge end face facing a surface of said outlet casing; characterized by a low friction wear resistant coating disposed on said surface of said outlet casing facing said discharge end faces of said rotors.

9. The screw machine of claim 8 wherein said low friction wear resistant coating comprises a diamond-like-carbon coating made up of a series of alternating hard and lubricious layers.

* * * * *